United States Patent [19]

Meckenstock

[11] Patent Number: 4,858,788

[45] Date of Patent: Aug. 22, 1989

[54] DISPENSING DEVICE FOR DISPERSING LIQUID FROM A CONTAINER

[75] Inventor: Fritz Meckenstock, Wuppertal, Fed. Rep. of Germany

[73] Assignee: Mega Plast product- u. Verpackungsentwicklung Marketing Gesellschaft mit Beschränkter Haftung & Co., Nuremburg, Fed. Rep. of Germany

[21] Appl. No.: 101,120

[22] Filed: Sep. 25, 1987

[30] Foreign Application Priority Data

Sep. 30, 1986 [DE] Fed. Rep. of Germany ..... 3633173
Jul. 8, 1987 [DE] Fed. Rep. of Germany ..... 3722553

[51] Int. Cl.[4] ..... B65D 37/00

[52] U.S. Cl. ..... 222/207; 222/383; 417/478

[58] Field of Search ..... 222/94, 207, 209, 321, 222/335, 383, 386.5, 389; 417/478–480, 540–544; 239/329, 331, 333

[56] References Cited

U.S. PATENT DOCUMENTS

| | | | |
|---|---|---|---|
| 3,235,135 | 2/1966 | Robert et al. | 222/207 |
| 3,973,700 | 8/1976 | Schmidt et al. | 222/153 |
| 4,220,264 | 9/1980 | Gamadia | 222/207 |
| 4,222,500 | 9/1980 | Capra et al. | 222/207 |
| 4,222,501 | 9/1980 | Hammett et al. | 222/207 |
| 4,241,853 | 12/1980 | Pauls et al. | 222/207 |

FOREIGN PATENT DOCUMENTS 3509178 9/1986 Fed. Rep. of Germany .

*Primary Examiner*—Michael S. Huppert
*Attorney, Agent, or Firm*—Martin A. Farber

[57] ABSTRACT

A dispensing device for the discharge of liquids, particularly for the spraying of liquids, having a manually actuatable liquid dispensing device (E). For the continuous delivery of liquid the dispensing device is connected to a storage chamber (Sp) which is under volume contraction and with which an outlet (19) for the stored liquid communicates. In particular, at least one wall (Wa) of the storage chamber (Sp) can cooperate with a spring (47) having flip-flop (snap) action with residual restoring force and a control valve (V4) on the outlet side is shifted into its open position in said flopped-over position.

24 Claims, 3 Drawing Sheets

V4
Wa
Sp
V3
47
43
43'
43"
34
33
13
22
30
15
32
31
45'
18
45
P
z
z
21
19
5"
39
E
29
44
8
46
37'
37
38
49
35
34
36
27
A
K
5
28
26
5'
25
39
4
40
V1
41
2
42
3

48
47
1
F
14
1'

DISPENSING DEVICE FOR DISPERSING LIQUID FROM A CONTAINER

FIELD AND BACKGROUND OF THE INVENTION

The present invention relates to a dispensing device for dispensing liquids, particularly for the spray dispensing of liquids, which has a manually actuatable liquid dispensing device.

Such a dispensing device with which, for instance, hair lacquer can be applied is known from the cosmetic industry. For the application of the hair lacquer it is necessary to depress an actuating handle of the liquid dispensing device, as a result of which the hair lacquer is drawn in via a dispensing tube which dips into the hair lacquer and is then discharged out of a spray nozzle. Such an arrangement has the disadvantage that the hair lacquer is dispensed only upon the depressing of the actuating handle so that the spray jet is interrupted upon the return movement of the actuating handle. Thus it is not possible to obtain a continuous spray jet. A continuous spray would, however, be advantageous for uniform application of the hair lacquer. Dispensing devices with continuous dispensing of liquid could be used to advantage also in fields other than cosmetics.

Devices which permit the continuous dispensing of liquids are known in the form of spray cans which are filled with a propellant gas. These devices, depending on the propellant gas employed, however, are detrimental to the environment, and create a risk of explosion because of their pressurized contents.

SUMMARY OF THE INVENTION

The object of the present invention therefore is to provide a dispensing device of the introductory-mentioned type which makes continuous delivery of liquid possible, particularly a spray jet.

This object is achieved, in accordance with the invention, in the manner that the liquid dispensing device is connected to a storage chamber which is under volumetric contraction and with which an outlet for the stored liquid communicates. This device of the invention makes continuous dispensing of liquid possible in the manner that the storage chamber is filled by means of the liquid dispensing device, the stored liquid being acted on by pressure due to the volume-contracting action of the storage chamber. The liquid storage volume which is under pressure can leave the storage chamber continuously via the outlet. The feeding of the liquid into th storage chamber by means of the liquid dispensing device can, on the other hand, take place intermittently.

In accordance with a further development of the invention, the storage chamber may have extensible walls which automatically return into position. The extensible walls are expanded by the amount of liquid introduced via the liquid dispensing device so that a pressure is built up in the storage chamber. If the liquid is discharged continuously through the outlet then the walls automatically return to their original position. The storage chamber is preferably developed as a storage bellows.

The arrangement can be such that the liquid dispensing device is connected to the storage chamber via a pressure-controlled valve which opens in the direction of discharge. This valve fulfills two purposes: On the one hand, it opens the path for the quantity of liquid delivered by the liquid dispensing device into the storage chamber and, on the other hand, it prevents the quantity of liquid present in the storage chamber from flowing back into the liquid dispensing device. The valve is preferably formed of two series-connected, identically acting individual valves. This has the advantage that an optimal seal is obtained between the devices and interaction is avoided.

For the turning on and off of the stream of liquid given off through the outlet a control valve is connected to the outlet.

In accordance with a further development of the invention, the dispensing device is developed as a bellows pump. The bellows pump is preferably connected, via an inlet valve, to a riser which extends into the liquid to be dispensed.

The amount of liquid fed per unit of time by the liquid dispensing device is preferably greater than the amount of liquid discharged (dispensed) through the outlet during this same period of time.

For a structurally favorable construction which takes up only a small amount of space the storage bellows is arranged above or at the top of the liquid dispensing device.

As already stated, the liquid which is held under pressure in the storage chamber by the contraction action emerges in the form of a continuous jet while the feeding of the liquid into said storage chamber can take place intermittently. To this extent such a dispensing device is more advantageous than the manually actuatable dispensing devices available on the market which produce a spray jet which is more chopped up.

With the basic invention described, however, further measures can be employed as described below in order to make the intensity of the spray jet more uniform. Thus, with development an embodiment of the described up to now there is obtained at the start a somewhat weaker spray jet which accordingly is shorter and also of poorer aim due to gravity.

Therefore it is another object of the invention to obtain a continuous dispensing of liquid having for instance the quality of an equal quantity per unit of time so that therefore the full action of the spray jet is produced at the very start of the dispensing of the liquid.

This effect is obtained by having at least one wall of the storage chamber cooperate with a spring with flip-flop (snap) action and remaining restoring force and that in the flopped position a control valve on the outlet side is moved into the open position.

While retaining the advantages of the embodiment described above, a spray jet which is now stable from the very start is obtained. The liquid which is under contraction pressure is namely released only when a given, i.e. sufficiently high, internal pressure is present in the storage chamber. The device which defines this internal pressure is simple and suitable wherein at least one wall of the storage chamber cooperates with a spring with flip-flop action and remaining restoring force and that in the flopped position a control valve on the outlet side is moved into the open position. In this connection, the expansion stroke of the storage chamber is in favorable fashion used for controlling the opening of the valve. The spring withstands the expanding force until the desired pressure has been built up. This withstanding force then abruptly collapses. The internal pressure at this time, however, is still so great that the reserve of restoring force cannot go into action unless there is no further loading of the storage chamber, so that the contraction action expels the content which can still be discharged (dispensed) and the intended return of the wall of the storage chamber into its original position takes place. From a structural standpoint, it is furthermore advantageous for the spring to have the shape of a spherical segment in its basic position. The spherical segment shape creates favorable conditions for a uniform flip-flop action. In this connection it is furthermore useful for the spring to be shaped as a circular disk. The invention furthermore proposes also with regard to the desired central system that the spring have a central opening through which there passes a ram of the wall facing the side of the spring which is convex in the basic position, the free end of the ram acting on the control valve. It is furthermore advantageous in this connection that the wall be developed as an insert piece which closes off the storage chamber and has a channel which communicates with the inside of the bellows and also passes through the ram. The insert piece to this extent also forms the flow connecting bridge between the storage chamber and the outlet of the dispensing device. It is furthermore proposed that the insert piece have a bearing collar which is guided in a chamber which receives the storage bellows. The side of said collar which faces in the direction of discharge acts as abutment for the spring while the other side can serve as a push-on limiting stop for the structural part which creates the storage chamber. For the defining of the flip-flop action and the exact positioning of the spring, the latter rests peripherally against an end wall of the chamber containing the storage bellows located on the control valve side and the end wall has a central projection was a resting surface for the spring in the flopped position. Furthermore, it has been found advantageous for the liquid dispensing device to be developed as a piston pump which is connected to the storage chamber via an outlet valve. Such a liquid dispensing device is sturdy; it is furthermore simple to manufacture and requires only a few parts. A solution which is favorable for handling is obtained by developing the dispensing device in the form of a pistol with trigger acting on the piston of the piston pump. Such a device rests well in one's hand and furthermore creates another favorable condition for the proper aiming of the spray jet. Finally, the invention also proposes that the liquid dispensing device be connected via a riser to the inside of a container which contains the liquid to be dispensed. Through the riser, which, as a rule, extends down to the bottom, the liquid can be drawn out practically completely.

BRIEF DESCRIPTION OF THE DRAWINGS

With the above and other objects and advantages in view, the present invention will become more clearly understood in connection with the detailed description of preferred embodiments, when considered with the accompanying drawings, of which The object of the invention will be described in further detail below with reference to several embodiments, shown in the drawing, in which.

DETAIL DESCRIPTION OF THE PREFERRED EMBODIMENTS

Figure 1:
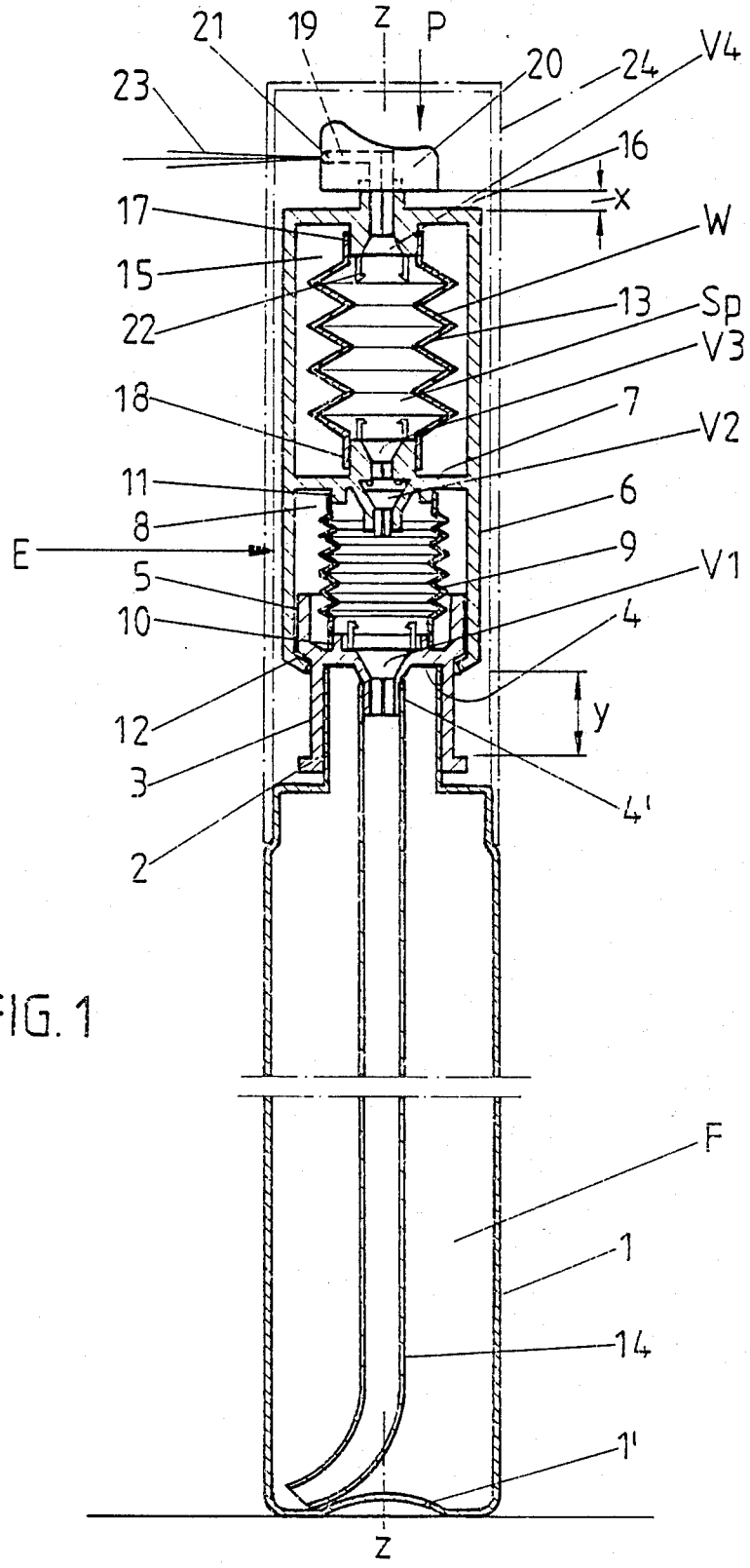
FIG. 1 is a diagrammatic showing of a liquid dispensing device, seen in basic position.

FIG. 1 shows the invention by example in one embodiment, showing the schematically represented liquid dispensing device E in its basic position, associated with a container 1 which contains the supply of liquid. The association may be of reversible but also of irreversible type, in the one case by screw thread and in the other case by the hammering of the liquid dispensing device onto the neck 2 of the container 1. In the embodiment shown in FIG. 1 a threaded connection is preferred.

From the corresponding screw cap 3 there extends a tubular section 5 which protrudes above the screw cap 3. On the wall of the tubular section 5 there is guided, limited axially by a stop, a housing part 6 which is also of tubular shape and which in its central region has a transverse bottom 7. Between the latter and the cover 4 the liquid dispensing device E forms a pump chamber 8 to receive an axially compressible pump bellows 9 so that a so-called bellows pump is present, such as explained, for instance, in Federal Republic of Germany OS 35 09 178. The accordion-shaped bellows walls forms at both ends an annular wall which, on the cap side, is placed over a collar 10 on the cap and, at the other end, is placed over a collar 11 which extends into the pump chamber 8. A clip-on connection can be used. The accordion-like pump bellows 9 acts as a spring element and holds the liquid dispensing device in the basic position shown. In this position, the lower inwardly drawn edge of the housing part 6 extends, limited by a stop, below a shoulder 12 formed on the tubular section 5 by an offset of its wall.

The inlet valve V1 of the liquid dispensing device E is located in the perforated center of the cap 3 while the corresponding outlet valve V2 is arranged also centrally in the perforated transverse bottom 7 of the container 1. Both of these valves are frustoconical bodies, the correspondingly inclined valve seat surfaces of which are produced by simultaneous shaping on the cover 4 and transverse bottom 7. The valve seat surface of the inlet valve V1 is continued downward into a nipple 4' which serves, on the one hand, for the guiding of the valve stem of X-shaped cross section and, on the other hand, for the attachment of a riser (tube) 14 which extends to the bottom 1' of the container 1, through which riser the liquid F passes into the pump bellows 9 by axial displacement of the housing part 6.

The liquid dispensing device E described above is connected to a storage chamber Sp which is under volume contraction (elastically expandable). The storage chamber Sp is arranged downstream of the chamber downstream of pump bellows 9 as seen in axial direction. For protected reception, the housing part 6 extends beyond the transverse bottom 7 into a chamber 15 which is closed on top by a cover 16. From this cover 16 a central collar or nipple 17 extends somewhat into the chamber 15. The upper end of the storage chamber Sp, which is also formed by an accordion-like bellows member (storage bellows 13), is clipped onto said collar; the lower end engages in corresponding fashion on a collar or nipple 18 which is also directed into the chamber 15. The storage bellows 13 forming the storage chamber is larger than the bellows 9 of the bellows pump and like the latter is made of expandable, fully restorable material.

The storage chamber Sp is also controlled via valves. The centrally open nipple 18 again has an inlet valve V3 and the nipple 17 of the cover 16 has an outlet valve V4, which, however, is developed as a control valve and bears the reference number V4. Once again, they have frustoconical valve seat surfaces of corresponding inclination. While in the region of the liquid dispensing device E a valve opening movement in the same direction is provided, an oppositely directed valve opening movement is provided for the storage region, the outlet valve V2 which is connected in series with the inlet valve V3 acting in the same direction; however, in the interest of independent movement, they are not connected to each other.

The fluid which is pumped into the storage chamber Sp passes, upon the opening of the control valve V4, into the outlet 19 of a dispenser head, developed as an actuating push button 20.

The outlet 19 comprises an angular channel with spray nozzle 21 arranged in its periphery on one side. The stop-limited displacement of the actuating push button 20 is effected on a centrally located length of tube extending from the cover 16 and within which the x-profiled stem of the control valve V4 is also guided. Said valve lies in sealing against its valve seat surface as a result of the pressure prevailing in the storage chamber Sp. Holding noses 22 extend, spaced axially apart, beyond the widened head of the valve member and thus effect the securing in position thereof upon assembly or in unfilled condition. Corresponding measures are also taken with respect to the valves V1 and V3. For valve V2 there is a corresponding securing as a result of the special development of the collar 18 present there.

The pressure actuating push button 20, which can also be under slight spring action, biasing it towards its basic position, lies at a distance x from the top of the cover 16, which distance corresponds to only a fraction of the actuating stroke y of the liquid dispensing device E.

The operation is as follows: For the actuating of the dispenser-like device, pressure is exerted in the direction indicated by the arrow P on the actuating push button 20. As a result, the control valve V4, first of all, opens. The fluid, for instance liquid, which is present under pressure in the storage chamber Sp due to the previous use passes out (being dispensed) with the formation of a delivery jet 23 transversely to the longitudinal center axis z-z of the device. The inlet valve V3 which acts in the same direction as the delivery valve V4 of the liquid dispensing device E initially remains closed as a result of the pressure. If, in the course of the further axial displacement in the direction of the arrow P the bellows pump is furthermore actuated in the following so-called working stroke y, then the fluid conveyed by the latter is forced into the storage chamber Sp which thereby supplements itself with further extension of its expandable walls. Hand in hand with this, the restoring force of its expandable walls effects the uninterrupted removal of the contents of the storage space. In order to produce a so-called continuous jet it is merely necessary to exert a plurality of small strokes. The full stroke is therefore not necessary. The storage space in all cases provides at all times a sufficient supply.

Upon the depressing of the housing part 6, the inlet valve V1 is closed as a result of the pressure within the pump bellows 9, but then, however, upon the spring-induced return of the housing part 6, it comes into the open position as a result of the vacuum then prevailing, which draws in the liquid F through the riser tube 14.

The quantity of liquid delivered per unit of time by the liquid dispensing device E is greater than the quantity of liquid discharged (dispensed) through the outlet 19 during the same period of time. The storage volume can be adapted in this respect to different types of fluids. In particular, a reduction in the cross section of the outlet due to an inserted spray nozzle supports this resultant effect. In this connection it is in particular essential for the invention that at all times and practically automatically the discharge (dispensing) path is first of all opened and this is followed by the actual pump actuation. Even when one's finger is merely just resting thereon, for instance upon the spring-biased return of the dispensing device, the dispensing jet is not interrupted. Only once the finger is lifted off completely does the control valve close, either as a result of the internal pressure present in the storage chamber or due to a return spring (not shown) in the dispenser head.

In order to avoid unintended opening, for instance by accidental contact in the direction of the arrow P, the control valve V4 can be secured, for instance by a blocking device, for which a turning movement would be suitable. An alternative protective measure is that of the conventional protective cap 24. The latter is attached to the housing 1 by a friction fit.

The portion of the liquid discharged from the receptacle 1 is replaced by air which is introduced via the neck 2. A valve-like measure can be utilized there (not shown in detail).

Figures 2, 3:
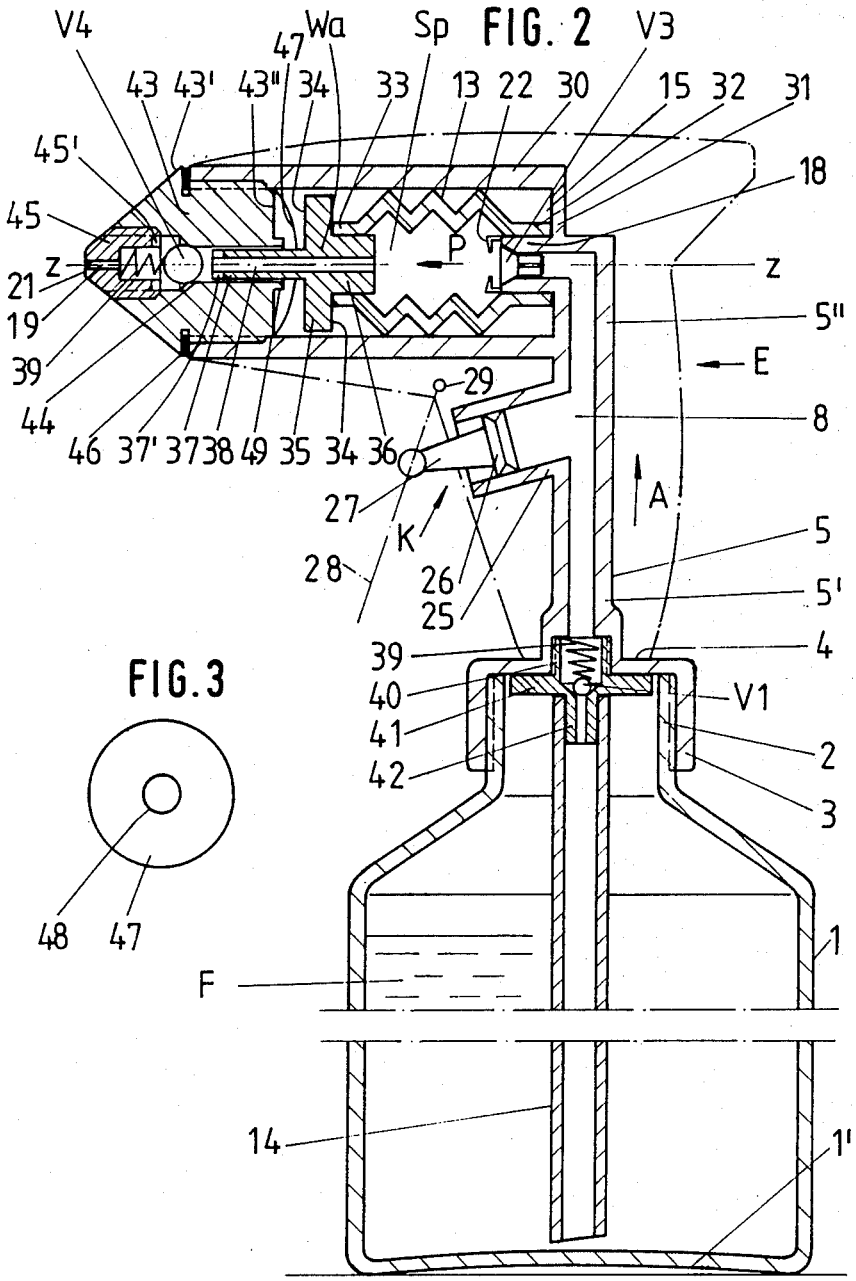
FIG. 2 shows another embodiment of a dispensing device, in vertical section, also in basic position.
FIG. 3 is a plan view of a spring of the dispensing device of FIG. 2, shown as a separate detail.
Figure 4:
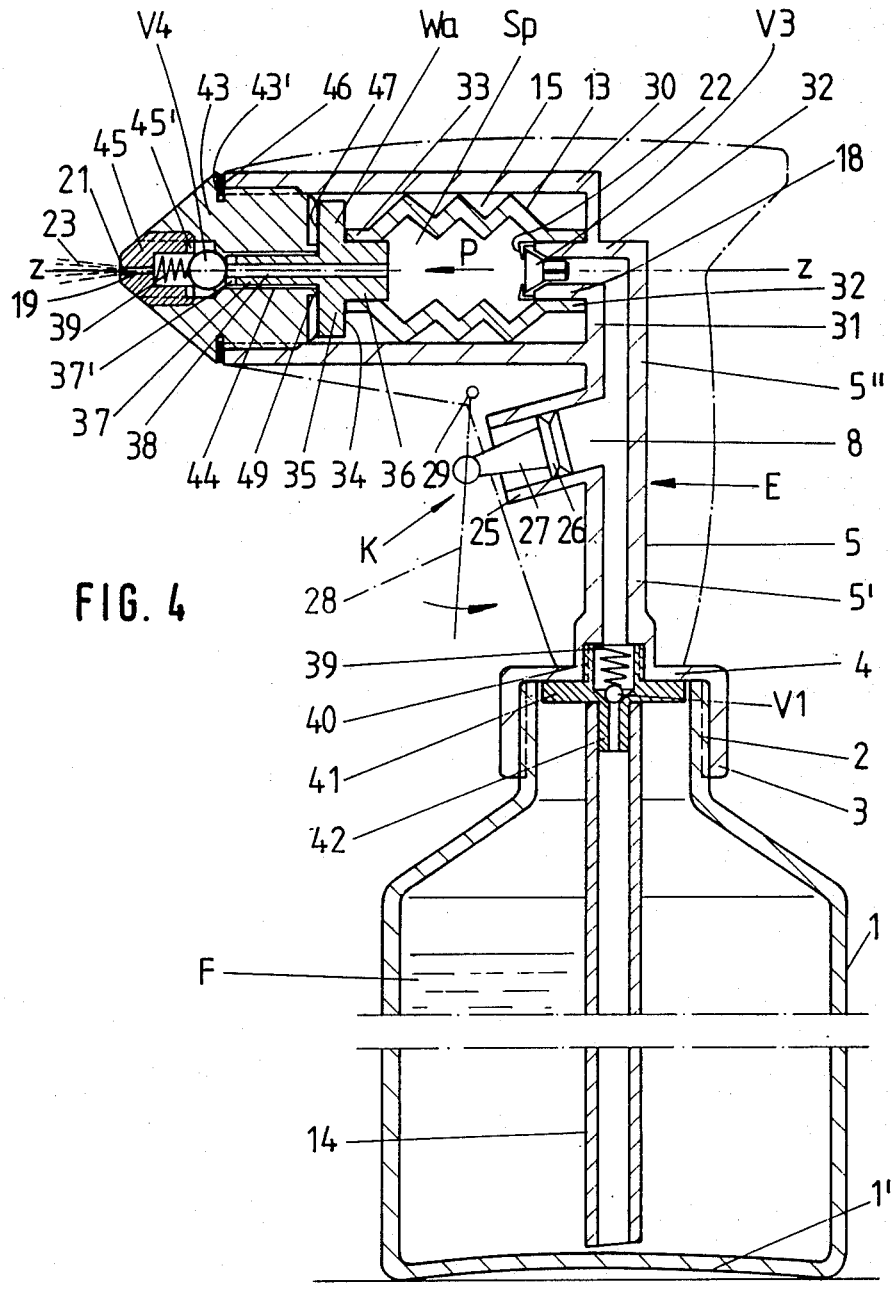
FIG. 4 shows the dispensing device in a sectional view similar to FIG. 2 but with the control valve in the open position and the trigger actuated.

FIGS. 2 to 4 show another illustrative embodiment. In this case the dispensing device shown has a container 1 which contains a supply of liquid F. The container 1 can be a bottle which is provided at its top with a narrower neck 2.

The neck 2 is connected to a liquid dispensing device E. The attachment of the two can be reversible or else irreversible, in the one case, for instance, by a threaded connection and in the other case, for instance, by the hammering of the liquid dispensing device E onto the neck 2 of the container 1. In the embodiment shown in FIG. 2 threaded a connection is preferred. For this purpose the liquid dispensing device E as a base part forms a screw cap 3 which bears an internal thread which fits the external thread on the neck 2.

The liquid dispensing device E is developed as a piston pump K. A vertical tube 5 which extends from the horizontal cover 4 of the protective cap 3 is a part thereof. A tube nipple 25 which is connected with the inside of the tube 5 and extends transversely to the tube 5 and slightly downward forms the pump space 8. The pump chamber 8 lies approximately at the center between a lower section 5' of the tube 5 and an upper section 5'' thereof. The pump chamber is cylindrical. A piston 26 travels within it. The piston 26 forms axially spaced lips which extend in sealing fashion along the cylindrical inner wall of the pump chamber 8.

An outwardly directed, centrally arranged shaft 27 is pivotally connected with some play to an actuating handle having the shape of a trigger 28. The trigger 28 is mounted with swinging motion around a fixed pivot pin 29 of the liquid dispensing device E which is developed here in pistol shape. The pistol-shaped contour is additionally indicated by dot-dash line in FIGS. 2 and 3. This can comprise shell-shaped halves which are assembled in the plane of swing of the trigger 28. Such shells can be produced individually or else directly as an integral part of the liquid dispensing device produced, for instance, by the plastic injection molding process.

The position of the trigger 28 corresponds to the manner of association customary in pistols and does not require any further explanation.

The vertically arranged tube 5 passes at its upper tube section 5'' located above the tube nipple 25 into a horizontally aligned chamber 15, attached at a right angle, which is comparable approximately to the barrel region of a pistol body. The chamber 15 is formed by a cylindrical housing part 30. In the transition region between chamber 15 and the upper tube section 5'' there is a vertically arranged bottom 31. The latter is continued as a collar 18 which extends into the chamber 15 and receives an inlet valve V3. Upstream of the latter, as seen in the direction of flow, arrow A, there is an inlet valve (V1). The latter lies partially in the tube sectioon 5' of the vertical tube 5 which lies below the plane of the pump chamber 8.

A riser tube 14 arranged in front of the inlet valve V1 provides the connection there with the liquid. The riser tube extends up to shortly in front of the bottom 1' of the container 1. The end of the riser tube present there is cut obliquely.

The liquid dispensing device E is connected with a storage chamber SP which is under volume contraction (elastically expandable). The storage chamber is arranged downstream of the inlet valve V3. It consists of an accordion-like bellows body of elastic or flexible material. Due to its resiliency, it acts at the same time as a spring element which in its relaxed basic position assumes the position shown in FIG. 2. The bellows folds are uniform. As a total three folds, resting against the cylindrical outer wall of the chamber 15, are present.

The corresponding storage bellows 13 which the bellows body forms has on both ends a connection collar 32 and 33 respectively. The collars are coaxial corresponding to the rotational-symmetric construction of the storage bellows 13. The collar 32 facing the centrally perforated bottom 31 is fitted tightly on the collar 18; the collar 33 which points in the opposite direction is attached to a comparatively stiff wall Wa of the storage chamber Sp. The wall Wa is developed as an insert member 34 which forms the cover there for the storage chamber. The insert member forms a disk-shaped bearing collar 35 which extends transversely to the horizontal longitudinal center axis z-z of the chamber 15 and therefore extends parallel to the bottom 31. Via this bearing collar 35 the insert member 34 is guided in the chamber 15. On the side of the bellows the vertical annular surface of said bearing collar 35 forms the push-on limiting stop for the push-on collar 33 there of the storage bellows 13. In the same direction, the bearing collar 35 is continued centrally in the form of cylindrical plug protrusion 36, corresponding approximately to the axial length of the push-over collar 33 of the storage bellows 13.

The side of the bearing collar 35 which faces away from the bellows forms a ram 37, which is aligned coaxially with the plug projection 36. The entire insert member 34 which is of rotational symmetry is open centrally. The corresponding channel is designated by the reference number 38. It connects the storage chamber Sp from the standpoint of fluid dynamics with an outlet 19 of the dispensing device. The end of the outlet 19 forms a spray nozzle 21. Between outlet 19 and the free end of the ram 37 there is a control valve V4. This control valve V4 as well as the inlet valve V1 are ball valves. Both are urged by springs towards the closed position. Each valve spring forms a conical spring 39 which is arranged in a correspondingly enlarged spring chamber, its larger base turn being fixed in position and its more closely wound head turn acting on the ball body.

In the case of the inlet valve V1 the valve-seat surface is formed by a threaded nipple 40. The external thread of the latter engages with a corresponding internal thread in the cover 4 of the screw cap 3. The transition region to the vertical tube 5 present there has a corresponding widening. The section which adjoins the screw nipple in the direction towards the riser tube 14 is of disk-shaped development. This disk 41, extending in the direction of the container 1, forms a central plug connector 42 over which the end of the riser tube 14 present there is placed. The entire member 40– 42 has a central hole, namely on top to create the spring chamber for the conical spring 39 and on bottom to form the valve seat and for the passage of the liquid F.

In the case of the control valve V4, the valve-seat surface is formed by a head piece 43 which can be screwed into the housing 30. Adjoining the valve seat surface, it forms a longitudinal bore 44 within which the ram 37 extends. By a milling of larger cross section towards the free end, the spring chamber is in part provided by the head piece 43. The balance is formed by a threaded nipple 45 which has the spray nozzle 21. The free section of the wall of said nipple and the adjoining free wall section of the head piece 43 are developed conically continuously without step. The taper is in the direction towards the spray nozzle 21. The conical region of the head piece 43 has a greater width than the threaded section thereof. In this way there is produced a step 43' which extends over the front edge there of the housing part 30, with the interposition of a sealing ring 46.

The end of the ram 37 facing the spherical body of the control valve V4 is transversely grooved. The same is also true of the inner end of the threaded nipple 45 facing the spherical body, so that despite contact with the spherical body an enveloping flow is present.

In one case these transverse grooves are designated 37' and in the other case 45'.

The wall Wa of the storage chamber Sp cooperates with a spring 47 which has a flip-flop (snap) action but residual restoring force. This is a sort of "pop spring." The force present in the direction of the arrow P results from the pump-induced filling of the storage chamber Sp and a horizontal forward displacement of said wall Wa related thereto. The corresponding stroke is used for the actuation of the opening of the control valve V4 in the manner that the front end there of the ram 37 in the "flopped" snapped-over position pushes the spherical body V4 off from its valve-seat surface against the force of the conical spring 39 acting on it. The corresponding release takes place suddenly.

The spring 47 is shaped in disk shape for the central free passage of the ram 37. In its basic position it has a uniform arching of a spherical segment (See FIG. 2). The central opening of the spring 47 is designated 48. The convex side lies in the direction of the wall Wa of the insert member 34. In the embodiment shown by way of example, there is still an axial distance between the zenith of the spring 47 and the side there of the wall Wa.

It can be referred to as a sort of idle stroke so that only after passage through this distance does the loading of the spring 47 commence.

The circular spring 47 rests peripherally against the end wall of the chamer 15 on the control valve side. This end wall is formed by the head piece 43 and is designated 43''. The end edge lies in the corner between said end wall and the cylindrical inner wall of the chamber 15. The corresponding position is secured as a result of the inherent tension of the spring in by clamping application. The opening 48 is, however, so large that there is no contact with the wall of the ram 37. In order to avoid the sudden movement of the spring body over into the corresponding mirror-image opposite position and therefore rather to secure the "flopped" snapped-over position with residual restoring force, a projection 49, commencing from the end wall 43'' of the head piece 43, extends in the direction towards the concave side of the spring 47. The end edge of the projection 49 supports the spring 47 which, under pressure, suddenly yields with flip-flop (snap) action. This projection is an annular wall which is concentric to the longitudinal bore 44 and passed through axially by the ram.

The inlet valve V3 between pump space 8 and storage chamber Sp is developed as a conical valve. The valve seat surface assumes a corresponding shape. The stem of the valve body is of x-shaped cross section. In order to secure the position of this valve body, holding projections 22 are provided. They grip, with axial spacing, over the widened head section of the valve body and thus produce a securing of its position upon assembly or in unfilled condition. The corresponding valve body is not spring loaded but could be so provided.

The operation is as follows:

Upon actuation of the trigger 28, liquid F is forced into the storage chamber Sp by the piston pump K via the riser 14. Upon the outward-directed stroke of the piston 26, the inlet valve V1 opens while the inlet valve V3 closes. Upon inward displacement of the piston 26, the situation is reversed; the inlet valve V1 closes and the inlet valve V3 opens. The liquid present in the pump chamber 8 and the tube 5 is pressed, by the corresponding displacement volume of the piston, into the storage chamber Sp. The storage bellows 13 now expands in opposition to the tendency towards contraction, the larger component lying in the direction of the arrow P. In this way there is a displacement of the wall Wa. Its bearing collar 35 comes against the spring 47 and loads the latter. The spring withstands up to a given internal pressure which is built up by the pump movements. Finally, the resistance of the spring is overcome. The ram 37 moves forward accordingly. It pushes the spherical body of the control valve V4 off from its valve seat surface. The liquid, which is under pressure, shoots out, flowing over the ball, into the outlet 19, leaving the nozzle opening 21 as a strong, stable jet. By further pump movements this condition is maintained since sufficient liquid is further brought into the storage chamber Sp. Only when the feeding thereof declines does the storage bellows 13 relax. Its force of contraction pulls the ram 37 back, supported further by the action in the same direction of the conical spring 39 and spring 47. The flopped-over position is eliminated as a result of the restoring force which is still inherent in the spring 47. The control valve V4 closes. The spring 47 is then again available as "intended-break" barrier for the next use in the manner which has been described.

I claim:

1. A dispensing device for the dispensing of liquid from a container, comprising a manually actuatable liquid dispensing device operatively connectable to the container, an elastically expandable storage chamber, the liquid dispensing device is connected to said storage chamber so as to feed liquid in the container into the storage chamber, means comprising an outlet for the stored liquid communicating with said storage chamber, a spring having snap action with residual restoring force, a control valve on an outlet side of said storage chamber is moved into an open position in a snapped-over position of the spring, the spring is formed with a central opening, a wall of said storage chamber in a basic position is opposite a convex side of the spring, a ram passes through said central opening, said ram has a free end engageable with the control valve.

2. The dispensing device according to claim 1, wherein said storage chamber is defined by elastically expandable, automatically position-returning walls.

3. The dispensing device according to claim 1, wherein said storage chamber is formed by a storage bellows.

4. The dispensing device according to claim 3, wherein the storage bellows is arranged above the liquid dispensing device.

5. The dispensing device according to claim 1, further comprising a pressure controlled valve means which opens in direction of feed from the liquid dispensing device and connects the liquid dispensing device to the storage chamber.

6. The dispensing device according to claim 1, wherein said control valve is connected to the outlet.

7. The dispensing device according to claim 1, wherein said spring is arched in the shape of a spherical segment in its basic position.

8. The dispensing device according to claim 1, wherein said spring is shaped as a circular disk.

9. The dispensing device according to claim 1, wherein the wall is formed as an insert member which closes off the storage chamber, said insert member having a channel communicating with the inside of the storage chamber, said channel also extends through said ram.

10. The dispensing device according to claim 9, further comprising a storage bellows defines said storage chamber, a housing chamber contains said storage bellows, and the insert member has a bearing collar which is guided in said housing chamber.

11. The dispensing device according to claim 10, wherein the spring rests peripherally against an end wall of the housing chamber, and said end wall has a central projection for resting thereon of the spring in the snapped-over position.

12. The dispensing device according to claim 1, further comprising an outlet valve which connects said liquid dispensing device to the storage chamber, and wherein said liquid dispensing device is formed as a piston pump.

13. The dispensing device according to claim 1, further comprising a piston pump having a piston and a trigger connected with the piston in pistol shape, the trigger acting on the piston of the piston pump.

14. The dispensing device according to claim 1, further comprising a riser tube which connects the liquid dispensing device to the inside of the container which contains the liquid to be discharged.

15. The dispensing device according to claim 1, wherein said manually actuatable liquid dispensing device upon manual actuations intermittently feeds the liquid from the container to said storage chamber, while said storage chamber by action of the force of expansion continuously dispenses the liquid in said storage chamber through said outlet.

16. The dispensing device according to claim 1, wherein said spring contractingly biases said wall of the storage chamber.

17. The dispensing device according to claim 1, wherein said means is a nozzle member forming said outlet and said wall is another member, said ram is formed on one of said members.

18. The dispensing device according to claim 17, wherein said ram is formed on said wall.

19. The dispensing device according to claim 1, wherein said outlet forms a spray nozzle.

20. A dispensing device for the dispensing of liquid from a container, comprising a manually actuatable liquid dispensing device operatively connectable to the container, an elastically expandable storage chamber, the liquid dispensing device is connected to said storage chamber so as to feed liquid in the container into the storage chamber, means comprising an outlet for the stored liquid communicating with said storage chamber, a spring having snap action with residual restoring force contractingly biases at least one wall of the storage chamber, and a control valve on an outlet side of said storage chamber is moved into an open position in a snapped-over position of the spring.

21. A dispensing device according to claim 20, wherein said spring directly biases said wall of the storage chamber.

22. The dispensing device according to claim 20, further comprising a riser tube which connects the liquid dispensing device to the inside of the container which contains the liquid to be discharged.

23. The dispensing device according to claim 22, further comprising an outlet valve which connects said liquid dispensing device to the storage chamber, and wherein said liquid dispensing device is formed as a piston pump.

24. The dispensing device according to claim 22, further comprising a piston pump having a piston and a trigger connected with the piston in pistol shape, the trigger acting on the piston of the piston pump.

* * * * *